US006050498A

United States Patent [19]

Minoura et al.

[11] Patent Number: 6,050,498

[45] Date of Patent: Apr. 18, 2000

[54] MULTIPLE COLOR PAINTING APPARATUS

[75] Inventors: Shuji Minoura; Daisuke Nakazono, both of Sayama, Japan

[73] Assignee: Honda Giken Kogyo Kabushiki Kaisha, Tokyo, Japan

[21] Appl. No.: 09/107,967

[22] Filed: Jun. 30, 1998

[30] Foreign Application Priority Data

Jul. 1, 1997 [JP] Japan ..... 9-176217

[51] Int. Cl.[7] ..... B05B 15/02

[52] U.S. Cl. ..... 239/112; 239/304

[58] Field of Search ..... 239/112, 113, 239/304

[56] References Cited

U.S. PATENT DOCUMENTS

| | | | |
|---|---|---|---|
| 4,337,282 | 6/1982 | Springer | 239/112 X |
| 4,400,147 | 8/1983 | Springer et al. | 418/206 |
| 4,592,305 | 6/1986 | Scharfenberger | 239/113 X |
| 4,813,603 | 3/1989 | Takeuchi et al. | 239/113 |
| 4,928,880 | 5/1990 | Prus et al. | 239/112 X |
| 5,288,525 | 2/1994 | Diana | 239/112 X |

FOREIGN PATENT DOCUMENTS

| | | | |
|---|---|---|---|
| 061630 | 3/1981 | European Pat. Off. . | |
| 0 061 630 | 10/1982 | European Pat. Off. . | |
| 4-326958 | 11/1992 | Japan | 239/112 |
| 7-108198 | 4/1995 | Japan . | |
| 7-185405 | 7/1995 | Japan . | |

*Primary Examiner*—Kevin Weldon
*Attorney, Agent, or Firm*—Merchant & Gould P.C.

[57] ABSTRACT

A multiple color painting apparatus has dedicated passages for carrying paints from a plurality of paint tanks each filled with paint of a different color. A single pump is disposed at the outlets of the dedicated passages. The delivery passage of the pump is used as a single common passage. A paint gun is connected to this common passage. As a result, when the paint color being used is changed it is not necessary for the dedicated passages to be washed with washing liquid and only the common passage from the pump to the paint gun need be washed.

1 Claim, 7 Drawing Sheets

1
2
2
2

MULTIPLE COLOR PAINTING APPARATUS

BACKGROUND OF THE INVENTION

1. Field of the Invention

This invention relates to a multiple color painting apparatus for painting, e.g., car bodywork.

2. Description of the Related Art

A multiple color painting apparatus is disclosed in Japanese Patent Laid-Open Publication No. HEI 7-108198. In this painting apparatus, paint is fed from multiple color-changing valves to a gear pump by one intake passage, whereafter the paint is fed by one delivery passage (supply pipe) from the gear pump to a paint gun and sprayed out through a nozzle hole.

However, with this painting apparatus, because the paint is carried by the single intake passage and the single delivery passage, when changing for example from white paint to red paint, it is necessary to wash the intake passage and the delivery passage with a washing liquid consisting of thinner. Consequently there has been the problem that because the length of passage that must be washed with thinner is long, a large quantity of thinner is required and the washing time also becomes long.

As means for solving this problem, for example an 'electrostatic painting machine' disclosed in Japanese Patent Laid-Open Publication No. HEI 7-185405 has been proposed. As shown in FIG. 1 of that publication, in this electrostatic painting machine, capillary nozzles are provided for a number of colors in a rotary spray head of a paint gun, and paints of different colors are carried separately by these nozzles. With this electrostatic painting machine, because a dedicated passage is used for each of the paints of different colors, the capillary nozzles do not have to be washed when changing between paint colors.

However, with this electrostatic painting machine, because multiple capillary nozzles are extended to the tip of the paint gun and a gear pump is provided for each of the multiple capillary nozzles, the construction of the painting machine is complicated and the painting machine is large.

It is therefore an object of the present invention to provide a painting apparatus with which the paint changing time is short and which is simple and compact.

SUMMARY OF THE INVENTION

To achieve this and other objects, the present invention provides a multiple color painting apparatus which comprises: a plurality of paint tanks to be filled with paints of different colors; a plurality of passages severally connected to the paint tanks for severally carrying paints from the tanks; a plurality of on/off valves severally disposed in the passages; one pump disposed at the outlets of the passages; and a paint gun connected to a delivery passage of the pump, the passages connecting the paint tanks to the pump being dedicated passages each dedicated to one paint and the delivery passage connecting the pump to the paint gun being a common passage.

According to the present invention, this multiple color painting apparatus may further comprise a washing liquid tank to be filled with washing liquid, a washing passage for carrying washing liquid from this washing liquid tank, and an on/off valve for washing disposed in the washing passage.

In a painting apparatus according to the present invention, the passages connecting the paint tanks to the pump are dedicated passages severally dedicated to paints of different colors and the delivery passage connecting the pump to the paint gun is a common passage. Therefore, when the paint color is changed for example from white to red, it is not necessary for the dedicated passages to be washed, only the common passage from the pump to the paint gun need to be washed, and the time required for washing at the time of a color change can be shortened. Also, because as a result of the delivery passage connecting the pump to the paint gun being made a single common passage, it is possible for a single pump to be used, the construction of the painting apparatus can be made simple, and the painting apparatus can be made compact.

As the arrangement of the washing passage and the paint passages, preferably the paint passages are disposed equally spaced in a circle around the washing passage, as this enables a confluence space formed inside the pump to be made small.

BRIEF DESCRIPTION OF THE DRAWINGS

Certain preferred embodiments of the present invention will now be described in detail with reference to the accompanying drawings, in which.

DETAILED DESCRIPTION OF THE PREFERRED EMBODIMENTS

In a first preferred embodiment shown in FIG. 1 through FIG. 6, passages for paint and a passage for washing are laid out in a flat plane to form a paint circuit and a washing circuit easy to understand.

Figure 1:
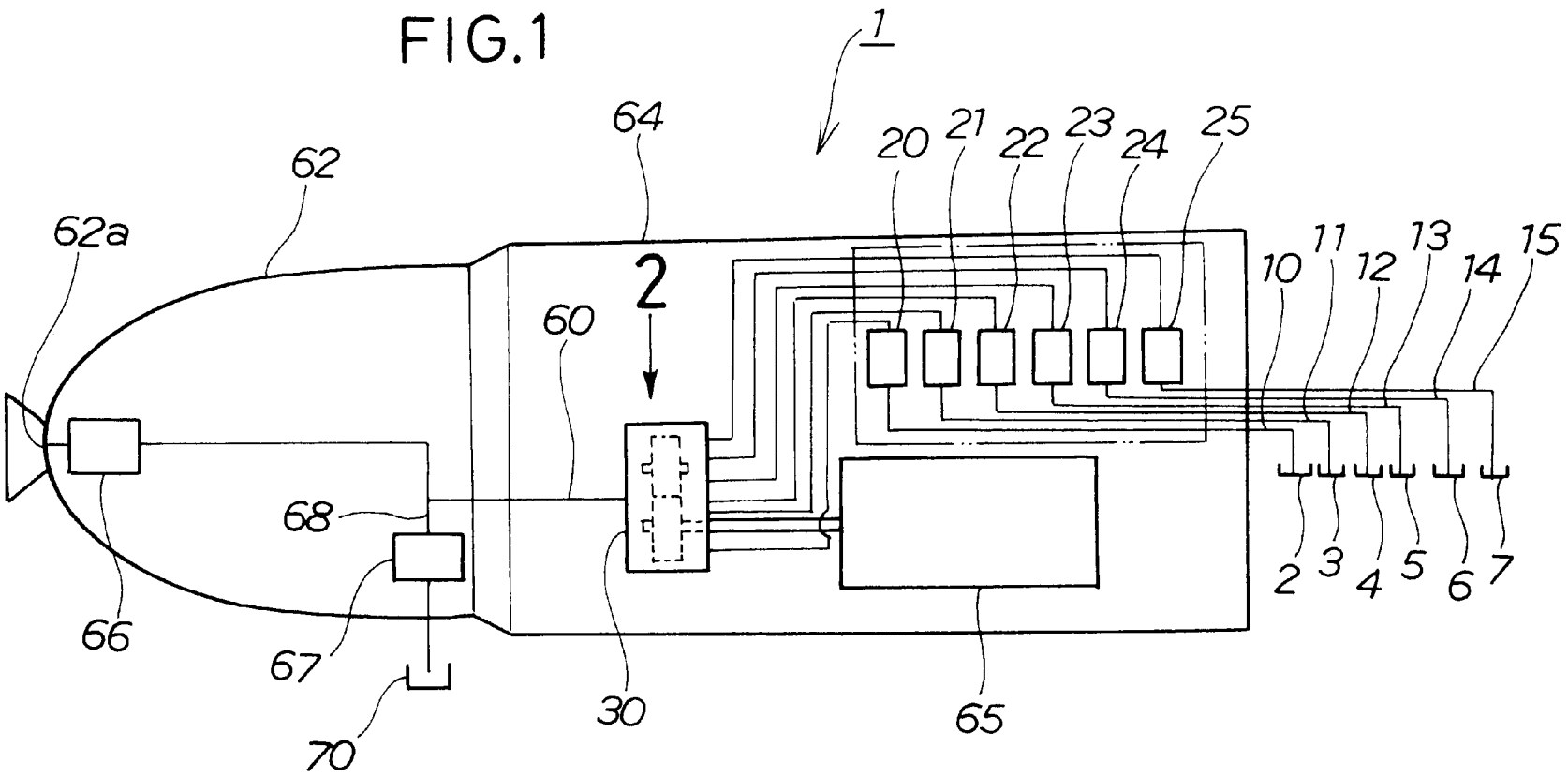
FIG. 1 is a schematic side view showing a multiple color painting apparatus of a first preferred embodiment of the present invention.

Referring to FIG. 1, the multiple color painting apparatus 1 of this preferred embodiment has first, second, third, fourth and fifth paint tanks 2, 3, 4, 5 and 6 filled with paints of different colors and a thinner tank 7 filled with thinner serving as a washing liquid. First, second, third, fourth and fifth passages 10, 11, 12, 13, 14 for carrying the paints are connected to these paint tanks 2 to 6. A washing passage 15 for carrying thinner is connected to the thinner tank 7. First, second, third, fourth and fifth on/off valves 20, 21, 22, 23, 24 are respectively provided in the first through fifth passages 10, 11, 12, 13, 14. An on/off valve for washing 25 is provided in the washing passage 15. A single pump 30 is disposed at the outlets of the first through fifth passages 10, 11, 12, 13, 14 and the washing passage 15. A delivery passage 60 extends from the delivery opening of this pump 30 to a nozzle hole 62*a* of a paint gun 62. The pump 30 will be described in detail with reference to FIG. 2 and FIG. 3.

To make the following description easy to understand, the first paint tank 2 will be assumed to contain white paint and the second paint tank 3 will be assumed to contain red paint. The third through fifth paint tanks 4, 5 and 6 will be assumed to contain paints of colors other than white and red.

The first through fifth passages 10 to 14 are independent dedicated passages each dedicated to one paint, and the washing passage 15 is also an independent dedicated passage. The delivery passage 60, on the other hand, is a common passage through which the paints of different colors flow commonly.

The reference numeral 64 denotes a cylindrical case mounted on the rear part of the paint gun 62. The pump 30 is driven by a drive motor 65. A trigger valve 66 is disposed in the delivery passage 60. A waste passage 68 is provided branching from the delivery passage 60. A dump valve 67 is provided in this waste passage 68, and a waste tank 70 is disposed at the end of the waste passage 68.

Figure 2:
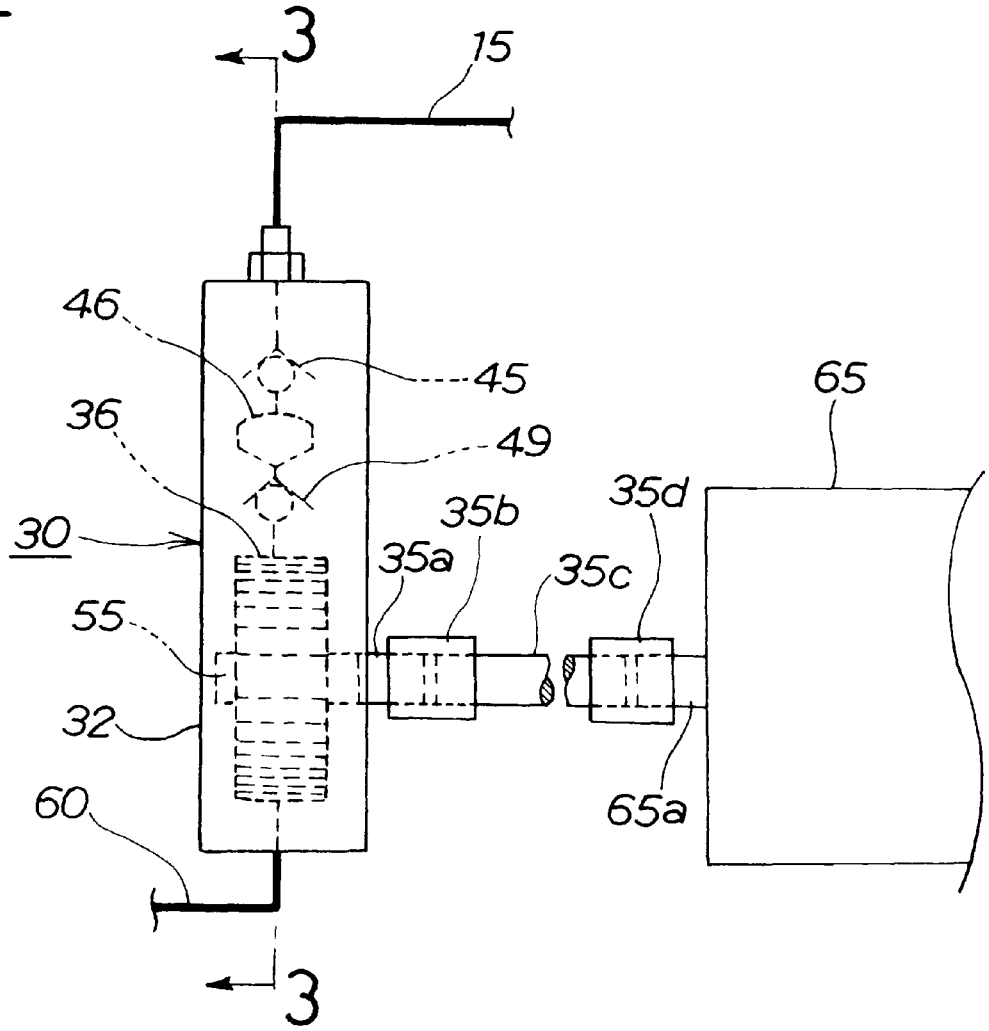
FIG. 2 is an enlarged view as seen in the direction of arrow 2 of FIG. 1.

In FIG. 2, the pump 30 is a positive displacement pump. A drive shaft 35*a* is attached to the pump 30. The drive shaft 35*a* is connected to a drive shaft 65*a* of the drive motor 65 by way of a first joint 35*b*, a connecting shaft 35*c* and a second joint 35*d*.

Figure 3:
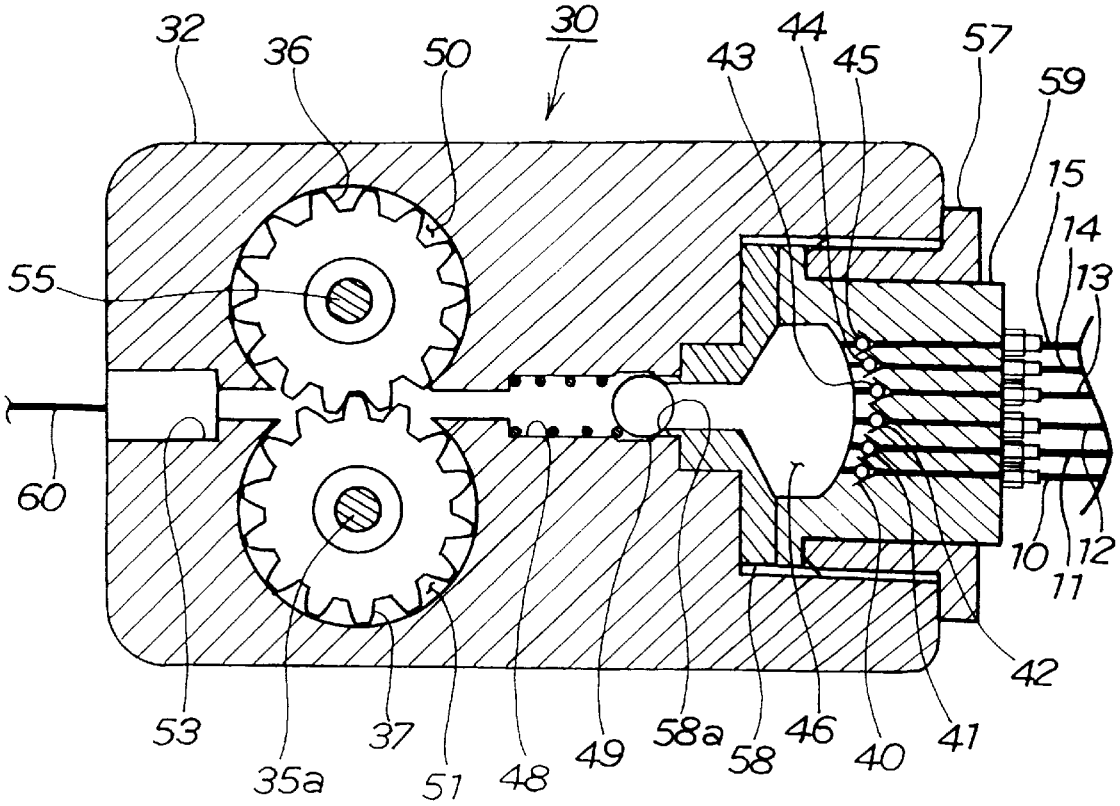
FIG. 3 is an enlarged sectional view taken along line 3—3 of FIG. 2.

Referring to FIG. 3, the pump 30 has first through fifth check valves 40 to 44 provided in the outlets of the first through fifth passages 10 to 14, a washing check valve 45 provided in the outlet of the washing passage 15, a confluence space 46 connected to the outlets of the first through fifth passages 10 to 14 and the washing passage 15, an intake opening 48 connecting with an outlet side of this confluence space 46, a check valve 49 provided in this intake opening 48, and first and second gears 36, 37 provided meshing with each other on an outlet side of the intake opening 48.

The first gear 36 is received in a first closed space 50 formed in a pump case 32. The second gear 37 is received in a second closed space 51 formed in the pump case 32. These first and second closed spaces 50, 51 connect with the intake opening 48. The second gear 37 is mounted on the drive shaft 35*a*. The first gear 36 is rotatably mounted on a shaft 55. The reference numeral 53 denotes a delivery opening.

A lock bolt 57 screws into the pump case 32 and thereby fixes inside the pump case 32 a first block 58 having a valve seat 58*a* and a second block 59 which together with the first block 58 forms the confluence space 46.

The first through fifth passages 10 to 14 from the paint tanks 2 to 6 (see FIG. 1) as far as the first through fifth check valves 40 to 44 are dedicated passages for the different colors. The washing passage 15 from the thinner tank 7 (see FIG. 1) to the washing check valve 45 is a dedicated passage for thinner constituting a washing liquid. On the other hand, the confluence space 46, the intake opening 48, the first closed space 50, the second closed space 51, the delivery opening 53 and the delivery passage 60 are common passages common to all the paints.

The operation of this multiple color painting apparatus 1 will now be described.

Figure 4A:
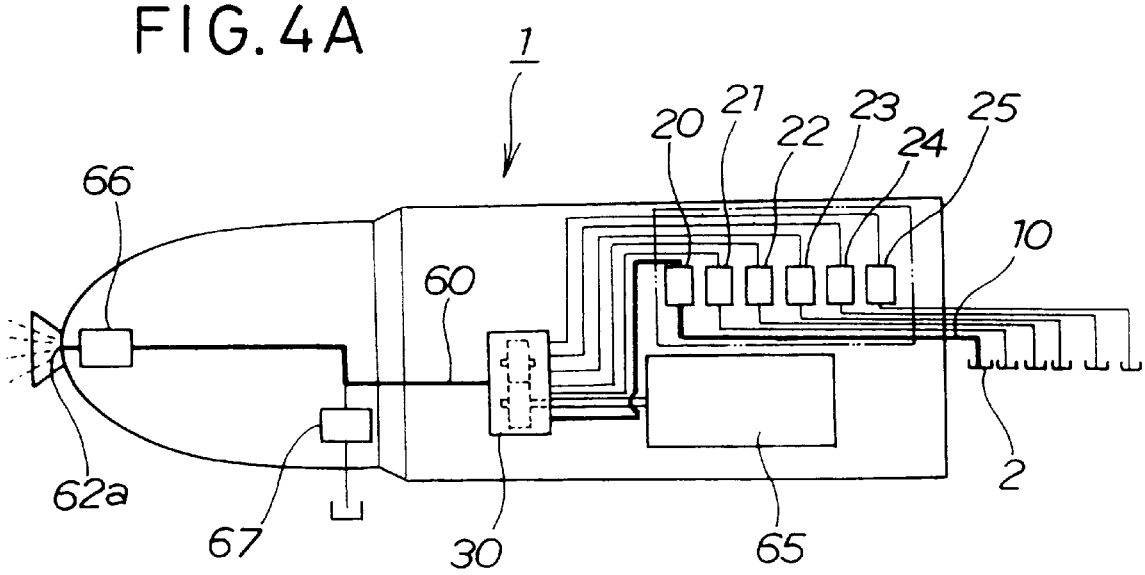
FIG. 4A and FIG. 4B are first operation-illustrating views of the multiple color painting apparatus of the first preferred embodiment.
Figure 4B:
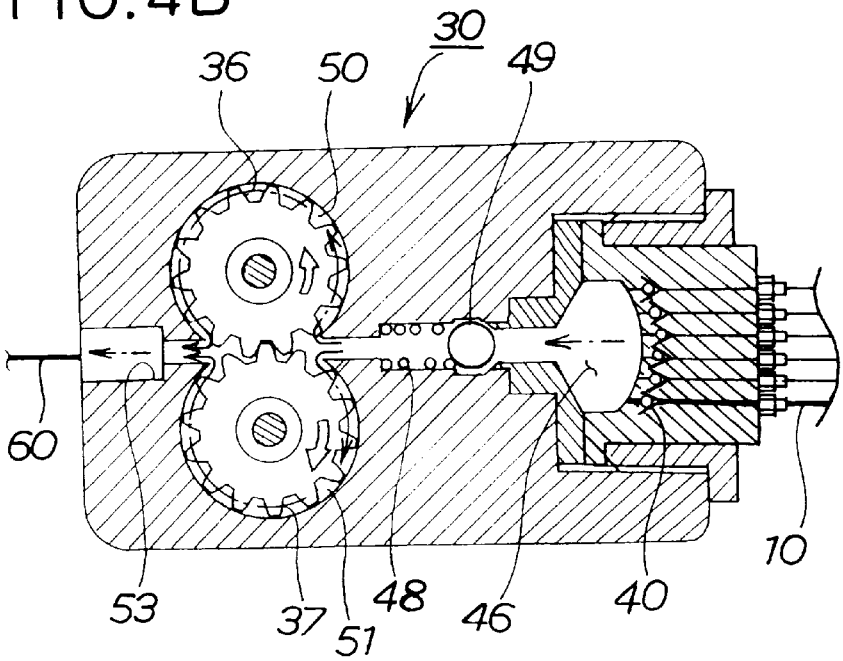

FIG. 4A and FIG. 4B are first operation-illustrating views pertaining to the multiple color painting apparatus of this first preferred embodiment, and illustrate an operation of spraying white paint.

In FIG. 4A, with the second through fifth on/off valves 21 through 24 and the on/off valve for washing 25 all set to off, the first on/off valve 20 is switched to on. Next, with the dump valve 67 set to off, the trigger valve 66 is switched to on. Then, the pump 30 is driven by the drive motor 65.

Because the first on/off valve 20 is on, white paint held in the first paint tank 2 passes from the first paint tank 2 through the first passage 10 (tank side), the first on/off valve 20, the first passage 10 (pump side), the pump 30, the delivery passage 60 and the trigger valve 66 and is sprayed from the nozzle hole 62*a* of the paint gun 62.

Thus if the delivery passage 60 is made common and provided as a single passage the painting apparatus 1 has a simple construction and does not become large. As a result, for example when a car body is being painted, even when the painting apparatus 1 is moved along the body, there is little disturbance of airflow and the body can be painted well.

In FIG. 4B, when the first gear 36 and the second gear 37 rotate in the directions shown with arrows, the intake opening 48 assumes a negative pressure, the check valve 49 and the first check valve 40 open, and as shown with dashed arrows white paint is delivered from the first passage 10 through the confluence space 46, the intake opening 48, the first and second closed spaces 50, 51, the delivery opening 53 and the delivery passage 60.

Figure 5A:
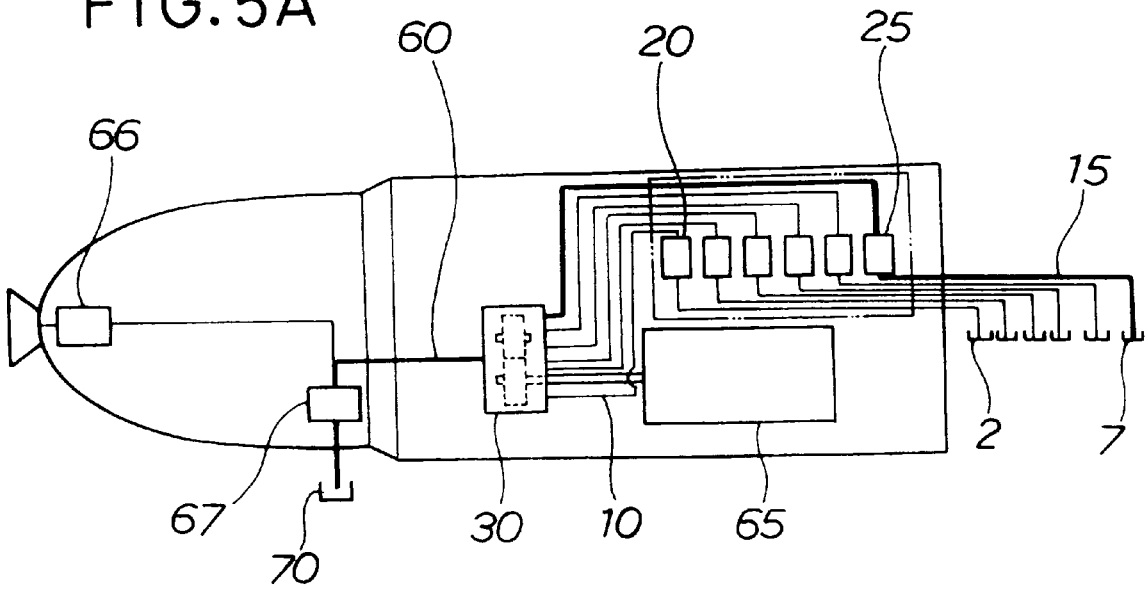
FIG. 5A and FIG. 5B are second operation-illustrating views of the multiple color painting apparatus of the first preferred embodiment.
Figure 5B:
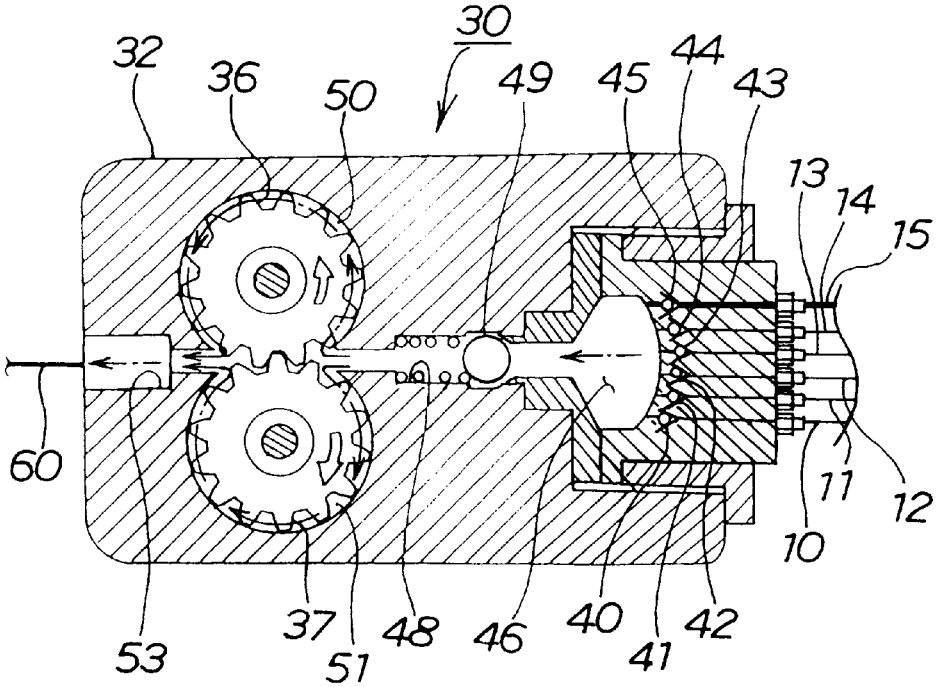

FIG. 5A and FIG. 5B are second operation-illustrating views pertaining to the multiple color painting apparatus of this first preferred embodiment, and illustrate an operation of washing a passage with thinner.

In FIG. 5A, the first on/off valve 20 is switched to off and the on/off valve for washing 25 is switched to on. Next, the dump valve 67 is switched to on and the trigger valve 66 is switched to off. Then, the pump 30 is driven by the drive motor 65.

Because the on/off valve for washing 25 and the dump valve 67 are on, thinner stored in the thinner tank 7 passes from the thinner tank 7 through the washing passage 15 (tank side), the on/off valve for washing 25, the washing passage 15 (pump side), the pump 30 and the delivery passage 60 and then passes through the dump valve 67 and is discharged into the waste tank 70. As a result, the pump 30 and the delivery passage 60 are washed with thinner and have white paint removed from them.

In FIG. 5B, when the first gear 36 and the second gear 37 rotate in the directions shown with arrows, the intake opening 48 assumes a negative pressure, the check valve 49 and the washing check valve 45 open, and as shown with dashed arrows thinner passes from the washing passage 15 through the confluence space 46, the intake opening 48, the first and second closed spaces 50, 51 and the delivery opening 53 to the delivery passage 60.

When thinner flows from the washing passage 15 to the delivery passage 60, because the confluence space 46 is a relatively large space, thinner is introduced to the whole of the inside of the confluence space 46. As a result, white paint remaining in the short section of the first passage 10 between the confluence space 46 and the first check valve 40, the confluence space 46, the intake opening 48, the first and second closed spaces 50, 51, the delivery opening 53 and the delivery passage 60 is removed by the thinner and these passages are thus cleaned.

Here, because the first through fifth check valves 40 to 44 are provided between the first through fifth passages 10 to 14 and the confluence space 46, there is no risk of thinner entering the first through fifth passages 10 to 14 from the confluence space 46.

Because, as shown in FIG. 5A, first passage 10 from the first paint tank 2 to the first check valve 40 is a dedicated passage it does not need to be washed with thinner, and since therefore only the confluence space 46, the intake opening 48, the first and second closed spaces 50, 51, the delivery opening 53 and the delivery passage 60 need to be washed with thinner, the washing time can be made short.

Figure 6A:
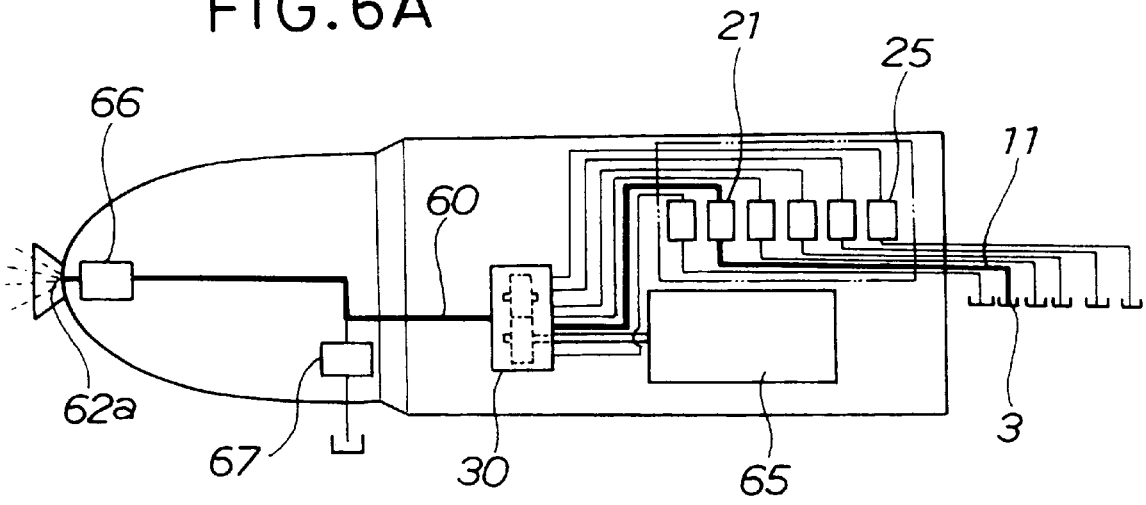
FIG. 6A and FIG. 6B are third operation-illustrating views of the multiple color painting apparatus of the first preferred embodiment.
Figure 6B:
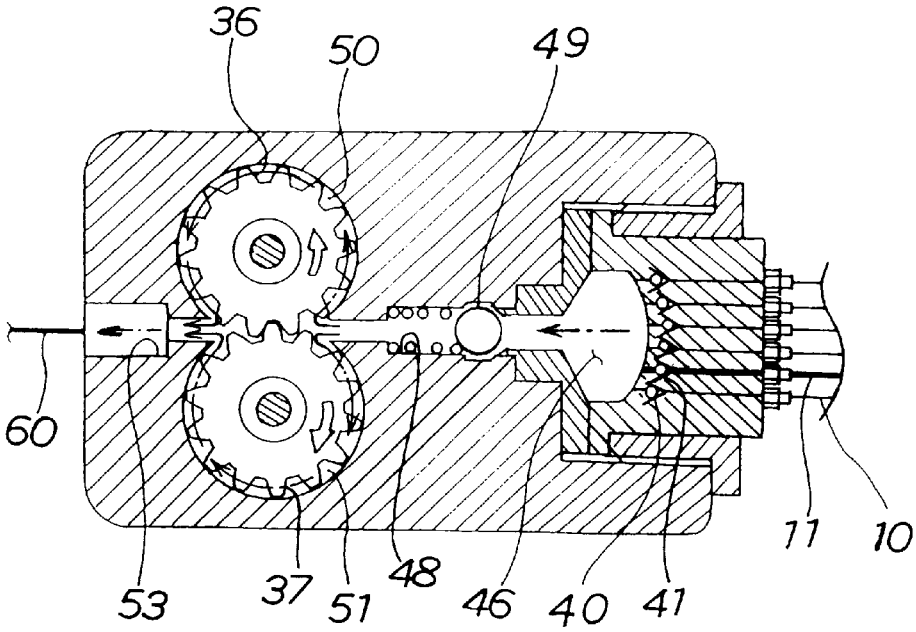

FIG. 6A and FIG. 6B are third operation-illustrating views pertaining to the multiple color painting apparatus of this first preferred embodiment, and illustrate an operation of spraying red paint.

In FIG. 6A, the second on/off valve 21 is switched to on, and the on/off valve for washing 25 is switched to off. Next, the dump valve 67 is switched to off, and the trigger valve 66 is switched to on. Then, the pump 30 is driven by the drive motor 65.

Red paint stored in the second paint tank 3 passes from the second paint tank 3 through the second passage 11 (tank side), the second on/off valve 21, the second passage 11 (pump side), the pump 30, the delivery passage 60 and the trigger valve 66, and is sprayed out through the nozzle hole 62*a* of the paint gun 62.

In FIG. 6B, when the first gear 36 and the second gear 37 rotate in the directions shown with arrows, the intake opening 48 assumes a negative pressure, the check valve 49 and the second check valve 41 open, and as shown with dashed arrows red paint passes from the second passage 11 through the confluence space 46, the intake opening 48, the first and second closed spaces 50, 51 and the delivery opening 53 to the delivery passage 60.

Because there is no white paint remaining in the short section of the first passage 10 between the confluence space 46 and the first check valve 40, the confluence space 46, the intake opening 48, the first and second closed spaces 50, 51, the delivery opening 53 or the delivery passage 60, there is no mixing of white paint with red paint.

Figure 7A:
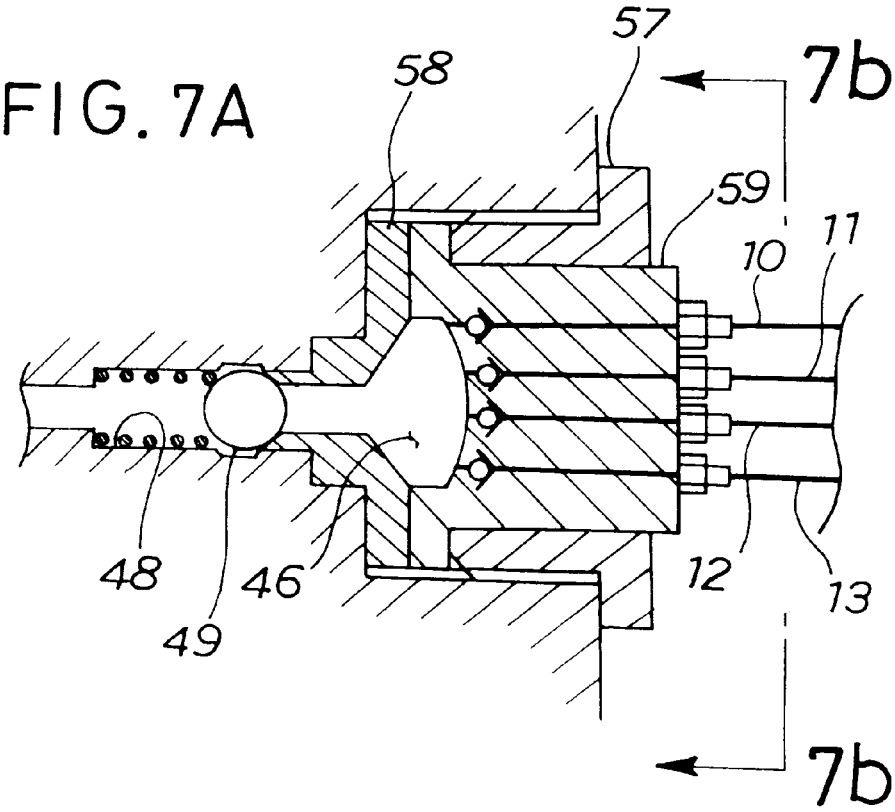
FIG. 7A and FIG. 7B are sectional views showing the relevant parts of a multiple color painting apparatus according to a second preferred embodiment of the present invention, FIG. 7B being a sectional view taken along line 7*b*—7*b* of FIG. 7A.
Figure 7B:
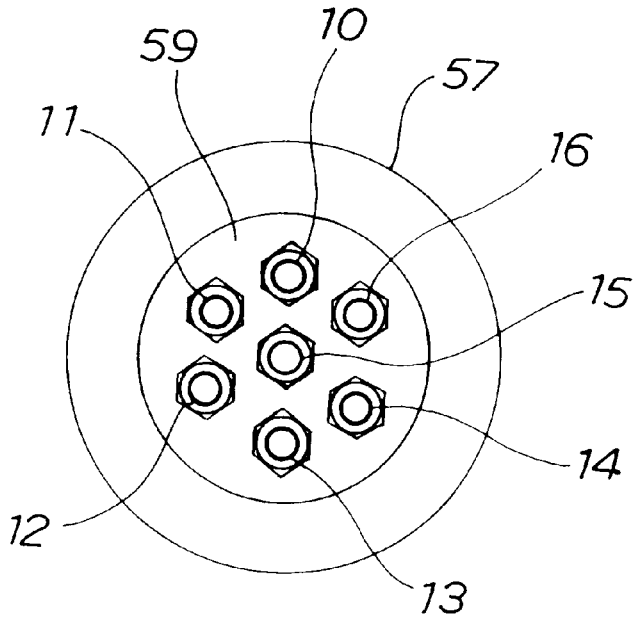

FIG. 7A and FIG. 7B are sectional views showing a main part of a multiple color painting apparatus pertaining to a second preferred embodiment of the invention. Parts in these figures the same as parts in the first preferred embodiment have been given the same reference numerals and will not be described here.

In the first preferred embodiment, to make the paint circuit and the washing circuit of the multiple color painting apparatus easy to understand, the first through fifth passages 10 to 14 and the washing passage 15 were arranged in a flat plane. However, in this invention, it is preferable for the first through fifth passages 10 to 14 to be arranged equally spaced on a circular arc around the washing passage 15, as shown in this second preferred embodiment. That is, when the washing passage 15 and the first through fifth passages 10 to 14 are arranged as shown in this second preferred embodiment, the confluence space 46 can be made small so that paint in the confluence space 46 can be washed out in a short time. The reference numeral 16 denotes a paint passage further provided in addition to the multiple paint passages shown in the first preferred embodiment.

Obviously, various minor changes and modifications are possible in the light of the above teaching. It is to be understood that within the scope of the appended claims the present invention may be practiced otherwise than as specifically described.

What is claimed is:

1. A multiple color painting apparatus, comprising:

a plurality of paint tanks each to be filled with paint of a different color;

a pump having an inlet side and an outlet side;

a plurality of supply passages severally connected for fluid communication between the paint tanks and the inlet side of the pump;

a plurality of on/off valves severally disposed in the supply passages;

a paint gun;

a delivery passage connected for fluid communication between the outlet side of the pump and the paint gun;

a washing liquid tank to be filled with washing liquid, a washing passage for carrying washing liquid from the washing liquid tank to the inlet side of the pump, and an on/off valve disposed in the washing passage, the inlet side of said pump including a block with the washing passage being connected to said pump at said block and with the paint supply passages being arranged equally spaced in a circle around the washing passage;

wherein the supply passages are each dedicated to one paint and the delivery passage is common to all paints.

* * * * *